United States Patent [19]

Lankamp

[11] 4,448,700

[45] May 15, 1984

[54] LUBRICATING COMPOSITION AND METHOD OF MAKING SAME

[75] Inventor: Herman Lankamp, Odijk, Netherlands

[73] Assignee: SKF Industrial Trading and Development Co., B.V., Nieuwegein, Netherlands

[21] Appl. No.: 383,585

[22] Filed: Jun. 1, 1982

Related U.S. Application Data

[63] Continuation-in-part of Ser. No. 95,573, Nov. 19, 1979, abandoned.

[30] Foreign Application Priority Data

Jun. 12, 1978 [NL] Netherlands ..... 7811913

[51] Int. Cl.[3] ..... C10M 7/14; C10M 7/24

[52] U.S. Cl. ..... 252/12.4; 252/12; 252/12.2; 252/32.5; 252/56 S; 252/51.5 A; 585/12

[58] Field of Search ..... 252/12.4, 12, 12.2, 252/51.5 A, 56 S, 32.5; 585/12

[56] References Cited

U.S. PATENT DOCUMENTS

| | | | |
|---|---|---|---|
| 3,114,708 | 12/1963 | Morway et al. | 252/12 |
| 3,808,133 | 4/1974 | Brown | 252/12 |
| 4,012,478 | 3/1977 | Horikawa et al. | 252/12 |

FOREIGN PATENT DOCUMENTS 54-114505 6/1979 Japan .

OTHER PUBLICATIONS

J. C. Benedyk, "Plastic Bearings; An International Survey", SPE Journal, Apr. 1970, vol. 26.

*Primary Examiner*—Jacqueline V. Howard
*Attorney, Agent, or Firm*—Daniel M. Rosen; J. David Dainow

[57] ABSTRACT

A lubricating composition having self oil-releasing properties comprising polypropylene having a low melt index and a synthetic lubricating oil based on one or more neopentylpolyol esters, the acid residues of which on the average, have a relatively short chain, which composition can be shaped into and behaves as a mechanical component.

20 Claims, No Drawings

LUBRICATING COMPOSITION AND METHOD OF MAKING SAME

This is a continuation-in-part of application Ser. No. 95,573 filed Nov. 19, 1979, now abandoned.

The invention relates to a lubricating composition having self oil-releasing properties comprising certain synthetic resins and certain synthetic lubricating oils as well as to a method for the preparation thereof, a method for lubricating objects, such as bearings, by means thereof and to objects, such as bearings, containing the lubricating composition in a solid condition.

Dutch Patent Application No. 66.12772, British Patent Specification No. 1,163,123 and U.S. Pat. Nos. 3,541,011, 3,547,819 and 3,729,415 describe lubricating compositions consisting of a high molecular weight polyalkylene, that is, a polyalkylene having a molecular weight of more than 1 million, and a lubricating oil, generally a mineral lubricating oil.

A polyalkylene having a molecular weight of less than 1 million as well as fillers, such as nylon powder may be included in the lubricating composition. When the amount of high molecular weight polyalkylane in the lubricating composition is from 5 to 90 per cent by weight, this composition behaves as self-supporting firm, rigid gel. This solid composition has an oily surface as a result of the exudation of oil from the composition. The solid composition may easily be used as a structural portion of a self-lubricating object, such as a bearing, wherein the composition slowly and gradually releases oil throughout the entire live of the object. In order to manufacture such an object, the space between the outer ring and the inner ring of a bearing may be provided with a dispersion of a weak gel composition containing mineral oil and less than 5 per cent by weight of high molecular weight polyalkylene in combination with an amount of high molecular weight polyalkylene while employing heating temperatures of 104° to 232° C. Upon cooling, the lubricating composition, in an example, may form the cage for the balls of the bearing. A certain looseness of the balls is necessary, however, due to contraction and exudation of the oil during the manufacture of the object this feature is obtained.

Only polyethylene has been described in the above references as a high molecular weight polyalkylene although polypropylene and polybutylene have been mentioned as possible polyalkylenes. It has now been found that, when using these polyalkylenes, it is not possible to produce solid lubricants for general use. When employing polyethylene having a crystalline melting point of about 110° C., the compositions become tacky and lose their lubricity at a temperature of more than 105° C. When employed in a bearing at such high temperatures, the above known compositions result in a forced discharge of the material from the bearing or seizing of the bearing.

Satisfactory results are also not obtained in many instances when using polypropylene having a crystalline melting point of 160° to 165° C. When blending, for instance, commercially available polypropylenes having a molecular weight of from 400,000 to 800,000 with a mineral lubricating oil, products are obtained having the consistency of a soft paraffin; such products being dry and not exudating oil and consequently being unsuited for use, for example, in bearings.

In accordance with the present invention, it has now been found that the desired result is obtained, however, with a combination of a certain polypropylene and one or more determined synthetic lubricating oils. The invention therefore concerns the provision of a lubricating composition containing polypropylene having a low melt index, and a synthetic lubricating oil based on one or more neopentyl-polyol esters, the acid residues of which, on the average, have a relatively short chain. In addition, the composition must have a thickness $\leqq 4$ mm. When using such a composition, the lubrication of objects, such as bearings, is possible at higher temperatures than attainable with the known compositions, for example at temperatures to about 150° C. The composition according to the invention can be shaped into and behaves as a mechanical component, and also has self oil-releasing properties.

The polypropylene used may be any of the commercially available polypropylenes having the melt index as described below. In this specification reference to polypropylenes include both propylene homopolymers and propylene copolymers for instance with ethylene or 1-butene. Preferably these polypropylenes have a melt index of from 0.3 to 1.0 g/10 minutes, determined in accordance with DIN 53735, ASTM D 1238 or ISO 1133 at a temperature of 230° C. and under a load of 2 kg. Generally the molecular weight of polypropylenes having such a melt index will be from 500,000 to 800,000, but in any case it is less than 1,000,000.

The amount of polypropylene in the lubricating composition is generally from 12 to 60 per cent by weight, preferably from 15 to 50 per cent by weight and especially from 15 to 30 per cent by weight.

The neopentylpolyol esters used in the inventive lubricating compositions are known per se (see for example, Lubrication and Lubricants, edited by E. R. Braithwait (1967) pages 185–186, and Ullmanns Encyklopadie der technischen Chomie, vol 15, page 292–293 (1964). These are esters of monocarboxylic acids and multi branched alcohols such as neopentyl glycol, trimethylol ethane, trimethylol propane, trimethylol butane, trimethylol hexane, pentaerythritol and dipentaerythritol.

Neopentylpolyol esters suitable for use in the inventive lubricating compositions contain acid residues having on the average a relatively short chain. It has been found in fact that when employing esters having acid residues containing on the average eight carbon atoms or more, mechanically weak compositions are obtained. In lubricating compositions according to the invention neopentylpolyol esters having acid residues containing eight carbon atoms or more may be present provided the average number of carbon atoms of the acid residues is less than eight. Generally commerically available neopentylpolyol esters consist of mixtures based on certain alcohol and several monocarboxylic acids. It has been proved advantageous for the average number of carbon atoms of the acid residues to be from 5 to 7, and is preferably from about 6 to 7.

Generally the products of commerce based on neopentylpolyol esters also contain certain additives for improving the lubrication performance. The commercially available product Mobil jet Oil II (a product of Mobil Oil Corporation) has been proved to be useful in the composition of the invention.

Neopentylpolyol esters are compatible with polypropylene in any proportion.

It has also been found that, although polypropylene in combination with triesters of phosphoric acid yields a mechanically high strength composition, such a composition has a lower oil dispensing power than a lubricating composition containing polypropylene and the above mentioned neopentylpolyol esters. It has been found that the neopentylpolyol esters in the lubricating composition of the invention may be replaced partially by triesters of phosphoric acid. In the latter case a mechanically high strength composition is obtained having good oil dispensing properties. When using such synthetic lubricating oil blends the maximally allowable synthetic lubricating oil content amounts to about 85 per cent by weight of the final lubricating composition.

Triesters of phosphoric acid are known per se as synthetic lubricants (vide Ullmanns Encyklopadie der technischen Chemie, vol 15, pages 294–295 (1964)). Examples of the triesters of phosphoric acid are trialkyl, tricycloalykyl, triaryl and/or alkylaryl esters of phosphoric acid and in which the hydrocarbyl radicals optionally possess the usual substituents. Preferably use is made of tricresyl phosphate.

When employing mixtures of neopentylpolyol esters and phosphates the mixture generally comprises from 5 to 60 per cent by weight of phosphates and from 95 to 40 percent by weight of neopentylpolyol esters.

Furthermore it has been found that advantages may be yielded by incorporating polyamides, such as polyamide 11(polyundocano amide) or polyamide 12 (polylaurolactam in the lubricating composition. When employing only these polyamides it is impossible to prepare a composition that releases oil. A combination of polypropylene, polyamide and one or more neopentylpolyol esters optionally admixed with phosphate esters yields a composition that releases oil and has flexible character dependent upon the amount of polyamides included, thus yielding a composition very well suited for sealing parts that are movable with respect to each other.

The polyamide may be present in an amount up to 60 percent by weight based on the mixture of polypropylene and polyamide. It is preferred however that this amount does not exceed 50 per cent by weight, based on the mixture of polypropylene and polyamide. A composition comprising polypropylene and polyamide may contain even over 80 per cent by weight of synthetic lubricating oil. In such a lubricating composition the amount of polypropylene plus polyamide is generally from 15 to 50 per cent by weight.

The invention also relates to a method for producing the above described lubricating compositions. The method includes blending the polypropylene in powdered form optionally together with polyamide in powdered form with the synthetic lubricating oil components of the composition, followed by heating the blend to a temperature above 180° C. and 250° C. The production may also be carried out in steps, for instance by first heating the polypropylene optionally in combination with polyamide to just above the crystalline melting point of polypropylene, for instance to a temperature of from 175° to 185° C., followed by incorporating the oil in the synthetic resin powder. The so called pre-flux material thus obtained may then be converted by further heating into the final composition and be brought in the desired shape thereof. The heating may for instance be carried out in the cylinder of an injection moulding or extrusion device. The moulding in a desired shape may be carried out in any suitable manner, for instance by injection moulding or extrusion. Upon cooling the composition capable of releasing oil is then obtained. The products produced may for instance be in the shape of bearing cages or slide bearing bushes. Alternatively, complete bearings (ball bearings and the like) may be filled with the lubricating composition of the invention, by injection moulding.

In the lubricating oil compositions of the invention fillers, such as talc, asbestos and fibre glass, may also be included if desired.

EXAMPLE I

Several batches of polypropylene in powdered form, commercially available as Hostalen PPH 1050 (Hoechst A. G.) (a propylene homopolymer having a melt index of about 0.3) were suspended in the commercially available product: Mobil Jet Oil II (Mobil Oil Corporation), a synthetic lubricating oil on neopentylpolyol ester base, followed by separately heating the mixtures thus obtained to 175° C. Thereby the polyproylene took up oil and yielded a so called pre-flux material. This pre-flux material was further worked up in an injection moulding apparatus having a cylinder temperature maintained at 230° C. Upon injection moulding solid articles having a relatively high mechanical strength and being capable of releasing oil were obtained. The solid articles produced in this way contained apart from the neopentylpolyol ester 15, 20 and 30 per cent by weight, respectively, of polypropylene.

In order to illustrate the lubricating capacity of the compositions prepared in accordance with this example available 6204 ball bearings were filled with the compositions and subsequently tested at 10,000 rpm at a temperature varying from 40° C. to 150° C. Under these circumstances the desired bearing lubrication was always attained.

EXAMPLE II 3 g of polypropylene powder (Hostalen PPH 1022 (Hoechst A. G.) (a propylene copolymer having a melt index of about 0.3)) was suspended in 20 g of Mobil Jet Oil II, followed by heating the mixture to 230° C. Upon cooling a mechanically high strength composition capable of releasing oil was obtained. A similar result was obtained when using polypropylene powder: Propathene HS 610E (ICI), a propylene homopolymer.

EXAMPLE III

A suspension of 3 g of Hostalen PPH 1022 in a mixture of 8.5 g Mobile Jet Oil II and 8.5 g of Houghto Safe 1120 (a tricresyl phosphate by E. F. Houghton and Co.) was heated to 240° C. Upon cooling a mechanically high strength composition was obtained having a good oil releasing capacity. A similar result was obtained when using Hostalen PPH 1050 and Propathene HS 610E.

However when suspending 10 g of polypropylene powder Hostalen PPH 1050 in 10 g of Houghto-Safe 1120 and heating the mixture to 200° C. 17 g of a lubricating composition containing 41 per cent by weight of phosphate ester was obtained. Such a composition however has only a slight oil releasing capacity when used under loaded conditions.

EXAMPLE IV 2 g of polyproylene powder (Hostalen PPH 1050) and 2 g of powdered polyamide 12 (Vestamid X 1891 (Chemische Werke Hüls A. G.)) were suspended in 16 g of Mobile Jet oil II, follwed by heating the mixture to 250° C. Upon cooling a mechanically high strength composition having a good oil releasing capacity was obtained.

EXAMPLE V 2 g of Hostalen PPH 1022 and 2 g of Vestamid X 1891 were suspended in a mixture of 7 g of Mobil Jet Oil II and 9 g of Houghto-Safe 1120, followed by heating the mixture to 250° C. Upon cooling a flexible composition having a good oil releasing capacity was obtained.

In a similar way compositions were produced in which the polypropylene, the polyamide 12, de neopentylpolyol ester oil and the phosphate ester oil were present in the following weight ratios:

| | | | |
|---|---|---|---|
| 2.5 | / 1.5 | / 8 | / 8 |
| 3 | / 3 | / 8 | / 6 |
| 3 | / 3 | / 7 | / 7 |
| 3 | / 3 | / 6 | / 8 |
| 2 | / 2 | / 8 | / 8 |
| 1.5 | / 2.5 | / 7 | / 9 |

The same results were obtained when using the polyamide powder Rilsan ES (ATO Chimie), a polyamide 11, and Pydraul 50 E (Monsanto Company), a phosphate ester oil.

EXAMPLE VI

For the two components of the self lubricating compound, the following materials were used.

polypropylene powder: Hostalen PPH1050 (Hoechst)

oil types: Mobiljet II (Mobil-oil), Isoflex All-time 28,46 and 62 (Kluber Lubrication)

The powder/oil mixtures were heated up to 165° C. while stirring until a viscous mass was obtained. Thereafter, the temperature was increased to 180° C. without stirring, until the mass became transparent. After cooling down to room temperature, the material was granulated by passing it through a rotary cutter.

The granulated material was molded in a Battenfelt type BSKM 45/20H moulding machine, comprising a horizontal injection unit and a vertical clamping unit.

A screw with a non-return check valve was employed. The following molds were made and used here to observe the degree of mold filling:

a mold for the preparation of standard tensile specimens (according to ISO R37, type S2)

a mold for filling 1204, 6204 and NJ204 bearings.

Granules from the different plastic/oil combinations of this example could be made by the above blending and granulation process.

The oil content in the granules was varied between 50 and 85%. The granules showed a dry appearance, thus being especially useful for conventional feeding in a hopper into the molding machine.

The injection molding was effected at different cylinder temperatures and injection pressures.

The solid lubricant materials of the invention required a low injection pressure (ranging from 1500 kPa for 85% oil content to 4000 kPa for 50% oil content) comparable to known solid lubricants (3000 kPa for a formulation with 60% oil content).

To avoid undue overheating (thermal decomposition and oil oxidation) the cylinder temperature was kept below 230° C., preferably between 180° and 220° C.

Typical molding conditions are given in Table 1. Molding of granules having more than 80% oil resulted during consecutive runs in oil separation in the cylinder, making further molding impossible. This behaviour was not observed for formulations with less than 80% oil.

The tensile specimens prepared by injection molding could easily be removed from the mold due to the oil exuding effect.

TABLE I

| molding parameters | granule oil content 60% oil | 80% oil |
|---|---|---|
| Cylinder temperature | | |
| rear | 160° C. | 160° C. |
| middle | 230° C. | 200° C. |
| front | 230° C. | 200° C. |
| injection pressure | 3500 kPa | 1700 kPa |
| injection time | 1,0 sec. | 1,0 sec. |
| hold pressure | 2800 kPa | 1000 kPa |
| hold time | 8,0 | 8,0 sec. |
| cycle time | 20 sec. | 22 sec. |

EXAMPLE VII

Test specimens of the solid lubricating material were prepared by injection molding according to the procedure detailed in Example VI.

In these samples, shrinkage was determined after one day storage of the tensile specimens at room temperature, and tensile strength and elongation at yield and at break was determined on Instron Model 1122 in accordance with ISO R 37, using a cross head speed of 50mm/min.

The oil exuding properties of the samples were determined by measuring the percentage of oil exuded from the specimens (in respect to its original oil content) after storage in air for 25 and 100 hours, respectively, at 100° C. The post shrinkage resulting from the oil exudation was measured from the decrease in length. In addition, the ability to exchange the original oil in a specimen for another type of oil was determined by measuring the weight change of the specimen after immersion in oil at elevated temperatures and determination of the final oil composition in the specimen by Infra-red analysis.

The mold shrinkage and oil exudation for a number of typical solid lubricant grades are given in Table II.

The tensile strength and elongation at yield/break as measured on the tensile bars for a number of formulations of the invention are given in Table III.

The oil exudation of the samples was thereafter studied in more detail on molded discs with diameter of 47 mm. The thickness of the discs was varied between 2 and 10 mm.

The oil exudation of these discs was found to decrease sharply with increased wall thickness. At ≦4 mm wall thickness thickness the oil bleeding stopped completely and the discs could easily be broken by hand. All broken discs showed a brittle core, often without any mechanical strength, surrounded by a thin tough skin of a thickness of approximately 1 mm.

Despite numerous experiments using different formulations (in total 23 ester oil types and 3 polypropylene types were tried) and different molding conditions, the above detrimental skin-core effect on oil exudation and strength could not be reduced.

The ability for oil exchange was studied by immersion of tensile specimens, containing 75–80% Mobiljet II, in the following oils: silicon oils (Dow Corning DC 710 and DC 560), polyglycol oil (Mobil Glycoyle 22), mineral oil (Spindle oil 22), phosphate ester oil Houghtosafe 1120), a polyphenylether oil and perfluoroalkylether oil (Fomblin-YR/Monticatini).

Apart from the latter, oil exchange was found to be nearly complete after 100 hours at 100° C or 1 day at 120° C.: only 1–3% of the original oil remained in the samples and the drop in total oil content was less than 5%. The specimens prepared in this manner from the phosphate ester oil showed fire-resistant properties.

Compared to known solid lubricants, all formulations in accordance with the invention have a lower mold shrinkage and a different oil exuding behaviour. The observed skin-core effect of the invention is attributed to a change in the polypropylene molecular structure: a "frozen-in" structure in the skin having oil exuding properties and a complete different structure in the core (formed during the long cooling down period after demolding) having the tendency to absorb oil. Thin moldings (much as the tensile specimens measured in Tables II and III) will only have the skin structure. Also for this structure, the oil exudation is of a different character than prior compositions. While the oil bleeding rate during the first day is comparable (≃1 mg per hour), the rate decreased with a factor 50 for compositions of the invention as compared to only a factor 6 for prior compositions.

The oil exchange tests indicate that the lubricant of the invention has an "open-cell" structure, allowing free flowing of the lubricant oil.

In each of the above examples of the self lubricating composition in accordance with the invention, satisfactory bearing properties were achieved only when the normal thickness, or section thickness, of the material was equal to or less than 4 millimeters. When the thickness of the bearing material was greater than this critical thickness, the bearing material ceased exuding oil, thereby ceasing its self lubricating properties. In addition, at thicknesses greater than this critical thickness, the mechanical strength of the bearing material drastically decreased, to become brittle and easily broken by hand.

Self lubricating compositions in accordance with the invention have also been tested as abradable seals. In one example, a ring comprised of a mixture of 35 per cent Hostalen PPH 1050 (Hoechst) and 65 per cent Isoflex Alltime 46 (Klueber) was injection molded. This ring was axially locked between a sealing finger and the mating sealing casing surface of a labyrinth seal. Interference was adjusted to 0.1 millimeters during assembly, to produce adequate seal pressure for initial sealing. This sealing system was tested on a train seal test ring with dust and water contaminent environments. The test results showed that the bearing material in accordance with the invention provides satisfactory results as an abradable seal with respect to friction characteristics. The highest running-in temperature measured was 40° C. as compared to the highest running-in temperature of 90° C. for garter seals and 75° C. for felt seals of conventional types. In addition, a water splash test showed that the sealing system did not leak.

While the invention has been disclosed and described with reference to a limited number of examples, it is apparent that modifications and variations may be made therein, and it is therefore intended in the following claims to cover such variation and modification as falls within the true spirit and scope of the invention.

TABLE II

| Oil Type | Oil content in granules (%) | Mould shrinkage (%) | Oil exudation (%) after 24 hrs/ 100° C. | Oil exudation (%) after 200 hrs/ 100° C. | Post shrinkage (%) after 24 hrs/ 100° C. | Post shrinkage (%) after 200 hrs/ 100° C. |
|---|---|---|---|---|---|---|
| Mobiljet II[1] | 75 | 1,5 + 0,1 | 8 | 10 | 1,5 | |
| Isoflex Alltime[2] 28 | 75 | 1,4 ± 0,1 | 8 | 10 | 1,5 | |
| Isoflex Alltime 62 | 50 | 2,5 ± 0,1 | 21 | 24 | 3,5 | 4,0 |
| " | 60 | 2,5 ± 0,1 | 22 | 25 | 4,6 | 5,3 |
| " | 70 | 3,3 ± 0,2 | 22 | 25 | 6,0 | 6,8 |
| " | 80 | 4,1 ± 0,1 | 28 | 31 | 8,0 | 9,1 |
| Isoflex Alltime 46 | 75 | 3,8 ± 0,2 | 26 | 30 | 7,1 | 8,1 |
| Isoflex Alltime 80 | 75 | 4,2 ± 0,2 | 29 | 32 | 8,0 | 9,0 |
| Reolub[3] 504 | 75 | 1,6 ± 0,1 | 11 | 12 | 2,0 | 2,3 |
| Reolub 602 | 75 | 2,4 ± 0,1 | 23 | 26 | 6,1 | 6,8 |

Notes
[1]Supplier: Mobil Oil
[2]Supplier: Kluber Lubrication
[3]Supplier: Ciba Geigy

TABLE III

| Oil Type | Oil Content in granules (%) | AT YIELD tensile strength ($N/mm^2$) | AT YIELD elongation (%) | AT BREAK tensile strength ($N/mm^2$) | AT BREAK elongation (%) |
|---|---|---|---|---|---|
| Mobiljet II | 50 | 10 ± 1 | 40 | 13 ± 1 | 580 |
| Mobiljet II | 60 | 7 ± 1 | 40 | 9 ± 1 | 430 |
| Mobiljet II | 70 | 5 ± 1 | 40 | 6 ± 1 | 390 |
| " | 80 | 2,5 ± 0,5 | 40 | 3,5 ± 0,5 | 360 |
| Isoflex Alltime 28 | 75 | 5 ± 1 | 40 | 6 ± 1 | 380 |
| Isoflex Alltime 62 | 75 | 2,0 ± 0,5 | 80 | 4,0 ± 0,5 | 750 |

What is claimed is:

1. A solid self lubricating bearing component comprised of a composition of finite thickness having self oil-releasing properties, said composition comprising polypropylene in an amount of from 12–60% by weight, having a melt index below 1.0, and 88–40% by weight of one or more synthetic ester oils, at least half of the oil consisting of neopentylpolyolesters having an average chain length of the acid function groups between 5–7, the other part of the oil being comprised of at least one compound of the group trialkyl-, tricycloalkyl-, and triarylphosphatesters, said composition being capable of being shaped by extrusion or injection molding into self-lubricating objects, said bearing component having a thickness up to 4 mm.

2. The lubricating bearing component of claim 1 wherein said composition further includes at least one filler of the group consisting of talc and asbestos.

3. The lubricating bearing component of claim 1 wherein said composition is reinforced by the addition of fibrous material.

4. The lubricating bearing component of claim 1 wherein said composition is comprised of 15 to 30 weight per cent of polypropylene.

5. The lubricating bearing component of claim 1 wherein said polypropylene has a melt index of from 0.3 to 1.0 g/10 minutes.

6. The lubricating bearing component of claim 1 wherein said polypropylene has a molecular weight of from 500,000 to 800,000.

7. A solid self lubricating bearing component comprising of a lubricating composition of finite thickness, having self oil-releasing properties, said composition comprising a mixture of polypropylene having a melt index below 1.0 and polyamide up to equal parts of both polymers in an amount of from 12–60% by weight, and 88–40% by weight of one or more synthetic ester oils, at least half of the oil consisting of neopentylpolyolesters having an average chain length of the acid functional groups between 5–7, the other part of the oil being comprised of at least one compound of the group consisting of trialykyl-, tricycloalkyl- and triarylphosphatesters, said composition being capable of being shaped by extrusion or injection molding into self-lubricating objects, said bearing component having a thickness up to 4 mm.

8. The lubricating bearing component according to claim 7 wherein said composition further includes at least one filler of the group consisting of talc and asbestos.

9. The lubricating bearing component of claim 7 wherein said composition is reinforced by the addition of fibrous material.

10. The bearing component of claim 7 wherein said polyamides are a polyamide of the group consisting of polyamide 11 and polyamide 12.

11. A method for the production of a solid lubricating structural bearing component having self-oil releasing properties, comprising mixing 12–60% by weight of a plastic material having at least 50% by weight of polypropylene with 88–40% by weight of one or more synthetic ester oils, said polypropylene having a melt index below 1.0, at least half of the oil consisting of neopentylpolyolester having an average chain length of the acid functional groups between 5–7, the other part of the oil being comprised of at least one triester of phosphoric acid, heating said mixture to at least 170° C. to provide a pre-flux material, and injection or extrusion molding said pre-flux material to form a solid bearing component with a finite wall thickness with a thickness of 4 mm or less.

12. The method of claim 11 wherein said plastic mixture is comprised solely of polypropylene.

13. The method of claim 11 wherein said plastic material is comprised of up to 50% of at least one polyamide.

14. The method of claim 11 wherein said heating comprises heating said mixture to a temperature between 180° C. and 2500° C.

15. The method of claim 11 further comprising heating said bearing component to a temperature between 150° C. and 160° C. for sufficient time to obtain good rolling characteristics when employed in rolling bearings prior to their use.

16. The method of claim 15 wherein said last named step of heating comprises heating said bearing component for about two hours.

17. A solid, self-lubricating, oil-releasing composition comprising:

a. 3–60% by weight, based on the total weight of the lubricating composition, of polypropylene having a melt index of from 0.3 to 1.0 g/10 min, determined in accordance with DIN 53 735, ASTMD1238 or 150 1133 at a temperature of 230° C. and under a load of 2 kg, or a mixture of such polypropylene and polyamide wherein the polyamide is present in an amount of no more than 50% by weight, based on the weight of the mixture of polypropylene and polyamide; and b. a synthetic lubricating oil consisting of neopentylpolyolesters, the acid residues of which have an average chain length of from 5 to 7 carbon atoms, wherein 5 to 60% by weight of said neopentylpolyolester, based on the total weight of the synthetic lubricating oil, may optionally be replaced by trialkyl, tricycloalkyl and/or triarylphospateesters.

18. A lubricating composition according to claim 1 characterized in that said composition is reinforced by addition of fibrous material such as glass fibres.

19. A method of making a lubricating composition according to claim 1 characterized by admixing the components of the composition, heating the mixture at above 180° C., preferably between 180° C. and 250° C., followed by cooling and moulding the composition in the desired shape.

20. The composition of claim 17 further comprising fillers and/or fibrous materials such as talc, asbestos and glass fibres.

* * * * *

UNITED STATES PATENT AND TRADEMARK OFFICE

CERTIFICATE OF CORRECTION

PATENT NO. : 4,448,700

DATED : May 15, 1984

INVENTOR(S) : HERMAN LANKAMP

It is certified that error appears in the above-identified patent and that said Letters Patent are hereby corrected as shown below:

In Col. 1, line 22, insert a comma after "powder";

line 24, change "polyalkylane" to --polyalkylene--;

line 32, change "live" to --life--.

In Col. 2, line 36, change "Chomie" to --Chemie-- and change "page" to --pages--;

line 61, change "jet" to --Jet--.

In Col. 3, line 16, change "tricycloalykyl," to --tricycloalkyl,- line 27, insert a closing parenthesis after "(polylaurolactam".

In Col. 4, line 64, change "polyproylene" to --polypropylene--;

line 67, change "oil" to --Oil-- and change "follwed" to --followed--.

In Col. 5, line 11, delete "de".

In Col. 6, line 54, delete "thickness" once.

In Col. 8, line 13, change "contaminent" to --contaminant--;

UNITED STATES PATENT AND TRADEMARK OFFICE

CERTIFICATE OF CORRECTION

PATENT NO. : 4,448,700

DATED : May 15, 1984

INVENTOR(S) : HERMAN LANKAMP

It is certified that error appears in the above—identified patent and that said Letters Patent is hereby corrected as shown below:

line 65, change "neopentylpolyolesters" to --neopentylpolyol esters--.

In Col. 9, line 1, change "triarylphosphatesters" to --triarylphosphate esters--;

line 21, delete "of" (first occurrence);

line 27, change "neopentylpolyolesters" to --neopentylpolyol esters--;

line 31, change "trialykyl-," to --trialkyl-,-- and change "triarylphosphat-" to --triarylphosphate--;

line 34, insert --of-- before "up";

line 53, change "polyolester" to --polyol ester--.

In Col. 10, line 13, change "2500°" to --250°--;

line 28, change "150" to --ISO--;

line 35, change "polyolesters," to --polyol esters,--;

line 38, change "polyolester," to --polyol ester,--;

UNITED STATES PATENT AND TRADEMARK OFFICE

CERTIFICATE OF CORRECTION

PATENT NO. : 4,448,700

DATED : May 15, 1984

INVENTOR(S) : HERMAN LANKAMP

It is certified that error appears in the above-identified patent and that said Letters Patent is hereby corrected as shown below:

line 40, change "triarylphosphateest-" to

-- triarylphosphate est- --.

Signed and Sealed this

*Twelfth* Day of *February 1985*

[SEAL]

*Attest:*

DONALD J. QUIGG

*Attesting Officer* *Acting Commissioner of Patents and Trademarks*